US005697215A

United States Patent [19]

Canevet et al.

[11] Patent Number: 5,697,215

[45] Date of Patent: Dec. 16, 1997

[54] EXHAUST PIPING FOR A CATALYTIC EXHAUST SYSTEM

[75] Inventors: Maurice Canevet; Michel Fouquembergh, both of Rueil-Malmaison, France

[73] Assignee: Aerospatiale Societe Nationale Industrielle, Paris, France

[21] Appl. No.: 549,768

[22] PCT Filed: Apr. 24, 1995

[86] PCT No.: PCT/FR95/00534

§ 371 Date: Dec. 1, 1995

§ 102(e) Date: Dec. 1, 1995

[87] PCT Pub. No.: WO95/29327

PCT Pub. Date: Nov. 2, 1995

[30] Foreign Application Priority Data

Apr. 27, 1994 [FR] France ..... 94 05079

[51] Int. Cl.[6] ..... F01N 7/14

[52] U.S. Cl. ..... 60/299; 60/272; 60/322

[58] Field of Search ..... 60/299, 322, 272

[56] References Cited

U.S. PATENT DOCUMENTS

| | | | |
|---|---|---|---|
| 3,209,856 | 10/1965 | Saunders . | |
| 3,850,453 | 11/1974 | Bentley et al. . | |
| 4,345,430 | 8/1982 | Pallo | 60/299 |
| 5,331,810 | 7/1994 | Ingermann | 60/322 |

FOREIGN PATENT DOCUMENTS

| | | |
|---|---|---|
| 3720714 | 1/1989 | Germany . |
| 1515462 | 6/1978 | United Kingdom . |
| 1546661 | 5/1979 | United Kingdom . |
| WO88/03602 | 5/1988 | WIPO . |
| WO91/02143 | 2/1991 | WIPO . |

*Primary Examiner*—Douglas Hart
*Attorney, Agent, or Firm*—Fisher, Christen, Sabol

[57] ABSTRACT

The invention relates especially to an exhaust piping for a catalytic gas exhaust system including a gas manifold and a catalyzer, said piping (4) being situated between said manifold and said catalyzer and provided with a composite tube (8) which consists of an internal tube and of an external tube defining between them a substantially annular space.

Advantageously, said composite tube (8) is housed inside said exhaust piping (4), the external tube coming substantially into contact with said piping, and said internal tube (10) and external tube (11) exhibit thin walls (10A, 11A), the thickness of which is less than 0.3 millimeter.

13 Claims, 3 Drawing Sheets

EXHAUST PIPING FOR A CATALYTIC EXHAUST SYSTEM

The present invention relates to exhaust piping for a catalytic exhaust system for a combustion engine, as well as to a composite tube especially intended, although not exclusively, to be associated with said exhaust piping.

As a result of the setting-up of new anti-pollution standards, exhaust systems of vehicles with combustion engines have to be equipped with catalyzers, the aim of which is to play an active part in the reduction of emissions into the atmosphere of more or less toxic combustion gases, so as best to preserve and respect the environment.

For that purpose, the catalyzer or catalytic converter of exhaust systems is connected to the outlet of the exhaust piping, the inlet of which is fixed to the manifold for combustion gases leaving the engine. Moreover, a muffler terminates the systems, being connected to the catalyzer by an exhaust pipe. Structurally, a catalyzer is composed of a rigid casing, inside which there is arranged a ceramic block or monolith with cells coated with alumina and precious metals (platinum, rhodium, etc.) which act, through catalysis, especially on carbon monoxide, the oxides of nitrogen, and unburnt hydrocarbons, in order to eliminate their harmful constituents and convert them into non-harmful emissions.

Furthermore, it is known that catalyzers are effective only when they reach a certain temperature (several hundreds of degrees), that is to say when the engine has been running for at least a few minutes, so that the monolith is sufficiently heated by the gases to initiate the catalysis reactions. As a consequence, as long as the monolith has not reached a given temperature, the gases leaving the engine are not processed, even though they do pass through the catalyzer. In addition, since the catalyzer is often remote from the manifold owing to the design of vehicles and safety criteria, its rise in temperature which is brought about by the gases traveling through the piping is all the more lengthy.

For this reason, in order to overcome these drawbacks, it has already been proposed to surround the exhaust piping on the outside by a composite thermal-insulation tube consisting of an internal tube, of an external tube and of thermally insulating substance provided between the internal and external tubes. In actual fact, it turns out that the catalyzer is not effective any more rapidly for doing so, because these composite tubes exhibit the following behavior:

- on the one hand, heat exchanges take place first of all across the exhaust piping which has a high heat capacity owing to its wall thickness of the order of 2 to 3 millimeters, so that the temperature rise time of the catalyzer is therefore too great, when the vehicle is being started from cold;
- on the other hand, the heat capacity of the piping is high and the composite tube surrounds said piplng so that the calorific energy of the gases when the engine is hot is not removed sufficiently, with the risk of the catalyzer being overheated if the temperature of the gases reaches about 1000° C.

The object of the present invention is to overcome these drawbacks, and it relates to exhaust piping for a catalytic gas exhaust system, the piping being equipped with a composite tube whose design greatly favors the rise in temperature of the catalyzer at the time when the engine is started, while not hampering heat exchange when the engine is hot.

To this end, the exhaust piping for a catalytic gas exhaust system including a gas manifold and a catalyzer, said piping being situated between said manifold and said catalyzer and provided with a composite tube which consists of an internal tube and of an external tube defining between them a substantially annular space, is noteworthy, according to the invention, in that said composite tube is housed inside said exhaust piping, the external tube coming substantially into contact with said piping, and in that said internal tube and external tube exhibit thin walls, the thickness of which is less than 0.3 millimeter.

Thus, as the composite tube is situated inside the piping, this arrangement allows rapid temperature rise of the catalyzer when the vehicle is started from cold and after each time it has been stopped, since the calorific energy of the gases is almost directly transferred to the catalyzer, without having to overcome the high heat capacity of the piping. The monolith of the catalyzer is therefore operational after a reduced warm-up time.

In contrast, when the engine of the vehicle is hot, and since the composite tube is thin and can be configured for heat transfer, giving this tube low thermal resistance, the composite tube forms no obstacle to the heat exchanges between the gases and the exhaust piping and can thus freely remove heat towards the outside by conventional heat exchange. Thus, the over-heating of the monolith which may lead to destruction thereof is avoided. As a consequence, by using thin walled internal and external tubes, giving the composite tube a low mass and therefore a low thermal resistance at high temperature, and by arranging said composite tube inside said exhaust piping, it is possible to bring the catalyzer into action rapidly when the engine is cold, while avoiding the risks of overheating when the engine is hot.

The invention also relates to a composite tube of the type including an internal tube and an external tube which define between them a substantially annular space, and which is intended to be associated with the exhaust piping of a catalytic gas exhaust system, which piping is situated between a manifold for said gases and a catalyzer of the system. It is then noteworthy in that the thickness of the walls of said internal tube and external tube is less than 0.3 millimeters and in that the outside diameter of said external tube is at most equal to the inside diameter of said piping.

Advantageously, the thickness of the walls of said internal tube and external tube is of the order of 0.15 to 0.20 millimeter. Thus, the heat capacity is further reduced. For preference, said internal tube and external tube are made of stainless steel.

Moreover in said annular space delimited by said external tube and internal tube, there is arranged a substance with low heat capacity and low density, in the form of particles or fibers. Thus, the main purpose of this substance is to transmit to the exhaust piping via the external tube the forces generated by the passage of the pressurized gases which are exerted on the thin internal tube, in order to avoid deformation of the latter. The intermediate substance therefore acts as a spacer to preserve acceptable mechanical behavior of said composite tube and it must be non-heat-conducting in order not to increase the heat capacity of the composite tube.

For example, the heat capacity of said substance is of the order of 0.25 kcal/kg and its density is at most equal to 0.3.

When said substance is more particularly in the form of particles, rings are provided at the ends of said internal tube and external tube, closing off said annular space in order to contain said substance. For preference, in each end of said tubes there are housed a flexible insulating ring, which is housed in said space and comes into contact with said substance of low heat capacity and low density, and a rigid, thermally resistant ring which is mounted in said space and comes into contact with said flexible insulating ring. Flexible insulating rings especially allow free expansion of the external and internal tubes, while the rigid rings provide for the centering of said tubes.

When said substance is more particularly in the form of fibers, fibrous windings may be fixed to the outside of said internal tube, and spaced apart by empty spaces, said external tube coming substantially into contact with the fibrous windings. For example, the latter are defined by a plurality of fibrous bands surrounding said internal tube fixedly and at regular spacings, and exhibiting a trapezoidal or similar cross section, rings being attached around said fibrous bands in order to fit inside said external tube and be fixed, by at least one of these, to said external tube.

Owing to the various shapes and lengths of exhaust piping, the composite tube advantageously consists of a plurality of individual elements which can be joined together. Thus, the composite tube can best be adapted to the piping in question. Quite clearly, each individual element comprises an external tube and an internal tube, both with thin walls, and a substance with low heat capacity and low density arranged between said tubes. Furthermore, when two individual elements are joined together, the corresponding ends of the internal tubes fit one inside the other, whereas the corresponding ends of the external tubes butt up against each other.

The figures of the appended drawing will make it readily understood how the invention may be embodied. In these figures, identical references denote similar elements.

FIG. 1 diagrammatically shows a catalytic gas exhaust system in which the exhaust piping in accordance with the invention is fitted with a composite tube.

Figure 1:
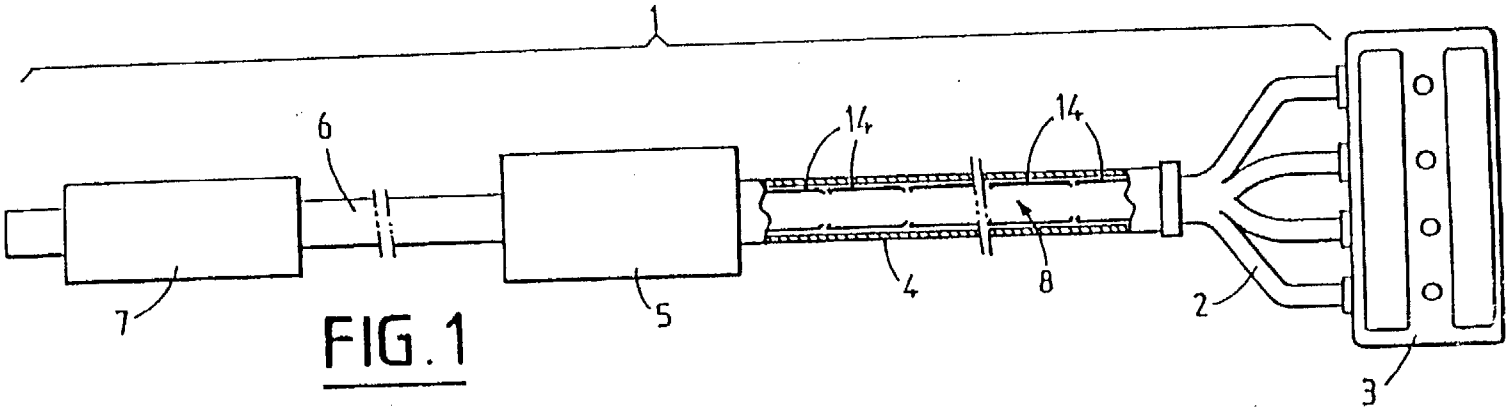

The exhaust system 1 illustrated in FIG. 1 in the usual manner comprises a manifold 2 for the gases leaving the combustion engine 3, exhaust piping 4 connected to the manifold, a catalyzer or catalytic converter 5 connected in turn to the exhaust piping and an exhaust pipe 6 connected to said catalyzer and comprising a muffler 7. Such a catalytic exhaust system thus makes it possible, as recalled earlier, to reduce the harmful emissions of gases leaving the engine, to the outside.

To provide for a rapid temperature rise of the catalyzer 5, the exhaust piping 4 is provided with a composite tube 8 which is composed of an internal tube 10, of an external tube 11 and of a substance 12 of low density, which is not a heat conductor, arranged in the annular space 9 delimited by the two tubes 10 and 11, preferably concentric and of circular cross section, like said piping.

According to the invention, the composite tube 8 is housed inside the exhaust piping 4 and the walls 10A and 11A which constitute the internal and external tubes are thin to exhibit a thickness less than 0.3 millimeter and, for preference, of between 0.15 and 0.20 millimeter. As may be seen in FIGS. 1 and 3, the composite tube 8 consists of a plurality of elements or of individual sections 14 joined one after another in the straight parts of the exhaust piping 4 which generally has a bend, to provide for the connection between the outlet from the manifold 2 and the inlet of the catalyzer 5. In FIG. 1 showing the system 1 diagrammatically, the piping 4 is straight but it goes without saying that in reality it is bent.

Dimensionally, the composite tube 8, formed of the individual elements 14, has an outside diameter defined by the external tube 11 of each element which is at most equal to the inside diameter of the wall 4A of the piping 4 to allow them to be fitted inside the latter. Also, in order to preserve the same passage cross section for the gases leaving the engine, the inside diameter of the piping 4 is increased, of the order of 10 millimeters for example, so that the inside diameter of the internal tube of each element is then identical to that of current piping.

Structurally, the internal tube 10 and external tube 11 of each element are made from a stainless steel which can thus withstand the high temperatures of the exhaust gas. The substance with low heat capacity and low density may, for its part, be of the particulate type, that is to say consisting especially of microspheres of SiO2 [sic] or the like, compacted or not compacted, or of the fibrous type, that is to say including especially long fibers of SiO2 [sic] or of Al2O3 [sic] for example. This substance has to be a refractory substance, withstanding temperatures of 1000° C. or more, lightweight and relatively flexible, and capable of transmitting the mechanical forces of the internal tube toward the external tube and thus toward the piping, without penalizing the heat capacity of the composite tube, particularly that of the internal tube 10. To achieve this, the mass per unit volume of the substance is less than 300 kg/m$^3$, while its heat capacity may be of the order of 0.25 kcal/kg or less.

Figure 2:
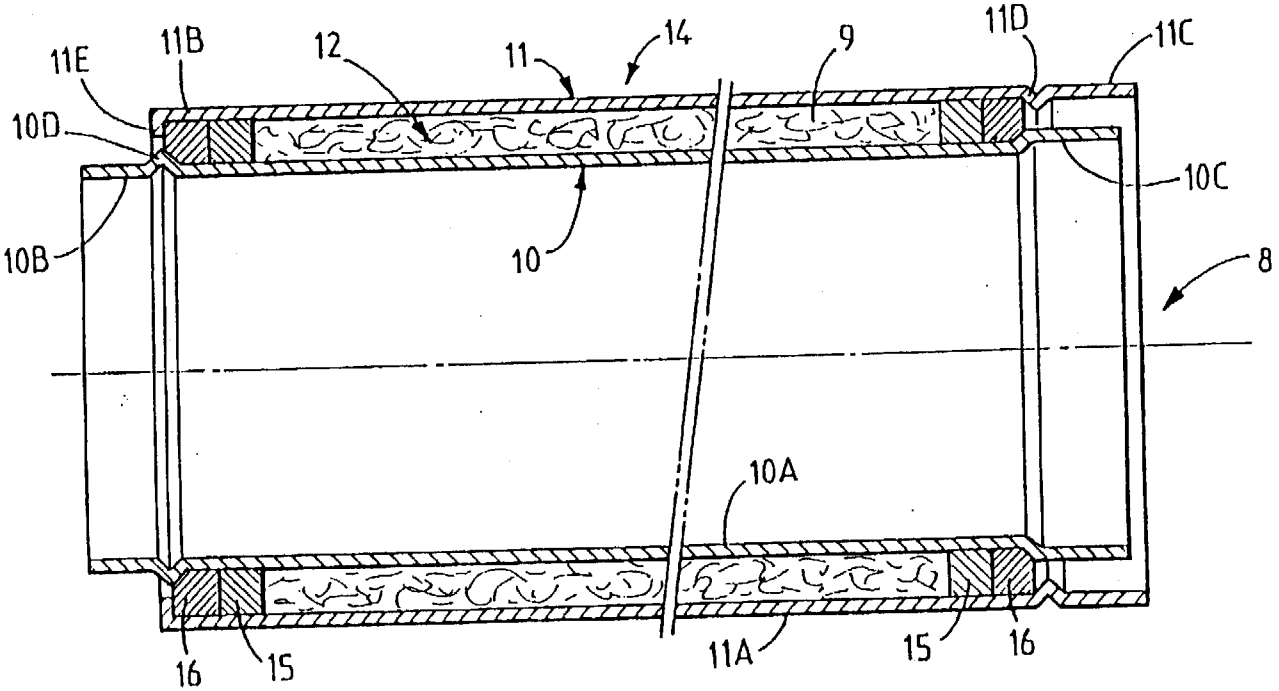
FIG. 2 represents one embodiment of one of the individual elements forming said composite tube.

According to the embodiment of the element 14 shown in FIG. 2, the substance 12 is of the particulate type. In this case, each element 14 of the composite tube 8 comprises rings at its annular ends delimited by the internal tube 10 and external tube 11. More particularly, two rings 15 are mounted close to the ends 10B, 10C, 11B, 11C of said tubes, in the annular space 9, in order thus to contain the substance 12 in the element 14. These rings 15 are also made of a flexible or semi-flexible insulating substance which allows the free expansion of the internal tube 10 relative to the external tube 11, both axially and diametrically, as a result of differences in temperature which may occur between the two tubes. Moreover, two more rings 16 are also mounted at the ends 10B, 10C, 11B, 11C of each element, coming into contact with the insulating rings 15. The rings 16 are made of a rigid substance, such as a dense alumina-based ceramic which is thermally resistant and not very sensitive to thermal shocks, and they hold the insulating rings 15, providing for the centering of the tubes 10 and 11 one relative to the other and allow the relative longitudinal and transverse extensions as they are mounted with play in the annular space 9 of the tubes.

For this reason, to immobilize said rings axially relative to the tubes of the element, there is provided, on one side of the element 14, an external radial projection 10D formed close to the end 10B of the internal tube and, on the other side of the element 14, an internal radial projection 11D formed close to the end 11B of the external tube.

Furthermore, it will be observed that the end 10B is in the extension of the wall 10A of the internal tube 10, while the opposite end 10C is slightly widened. Likewise, the end 11B of the external tube 11 ends in a part 11E turned in at right angles, while the opposite end 11C extends the wall 11A. For preference, the turned-in part 11E of the external tube is in the same diametral plane as the external projection 10D of the internal tube, and likewise the internal projection 11D is situated approximately in line with the changing cross section of the internal tube between its wall 10A and its end 10C. As a consequence, the rings 15 and 16, as well as the substance 12, are held in place axially in the annular space 9 of each element 14.

Figure 3:
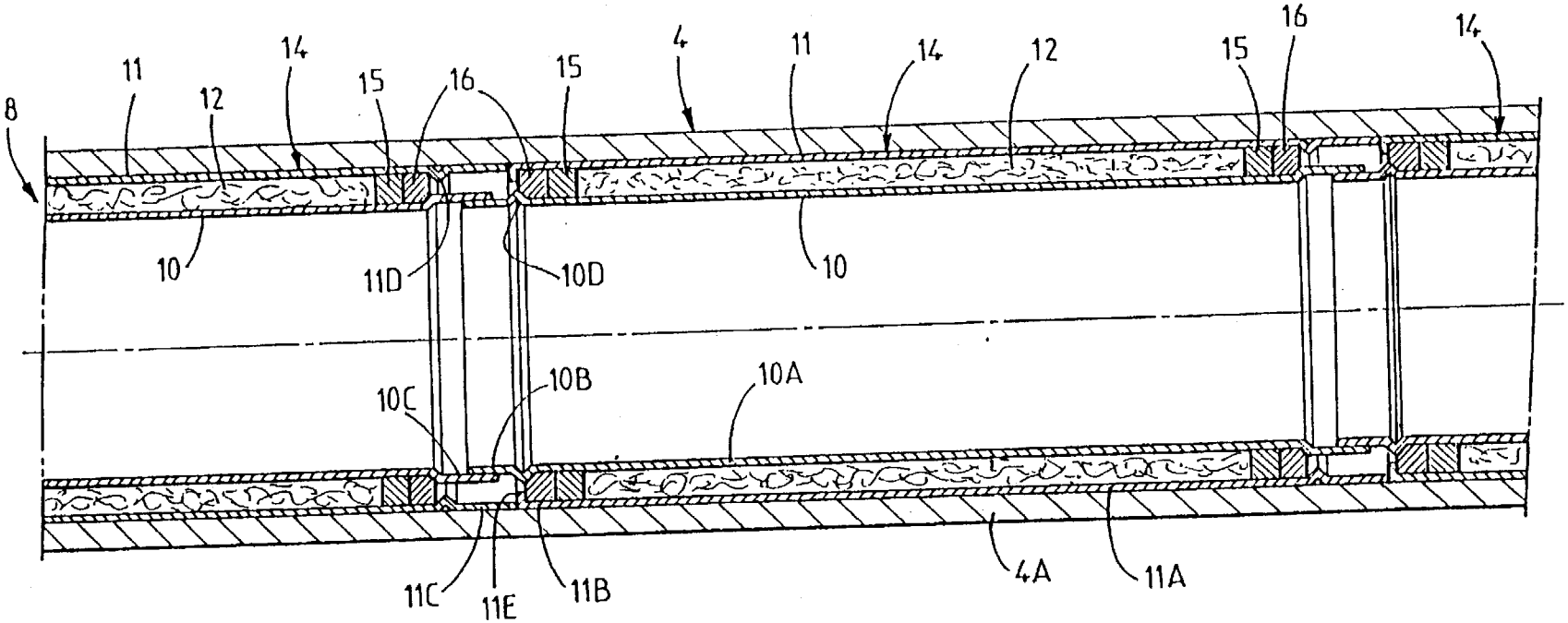
FIG. 3 shows individual elements of said tube, fitted in said exhaust piping.

The fitting-together of the individual elements 14 joined together is shown in FIG. 3. The end 10B of an element 14 is thus engaged with a small amount of friction in the widened end 10C of another contiguous element, which provides for their fitting-together until the moment when the turned-in end 11E of the external tube 11 of the element butts up against the end 11C of the other element.

The composite tube 8 with individual elements thus constitutes a modular system which makes it possible easily to line the inside of the exhaust piping 4.

The advantages afforded by the arrangement of such a composite tube 8 with a low heat capacity relate especially to the fast warm-up of the monolith of the catalyzer allowing almost instantaneous elimination of the toxic emissions of the gases. Indeed, during the transient period beginning from the time when the engine is started up and lasting for a few minutes, the heat exchanges and therefore the temperature of the exhaust gases are minimized as they travel down the piping, by the inside composite tube. In contrast, during an established period or cruise period, the small thickness of the composite tube does not hamper the removal of calorific energy toward the exhaust piping, the heat exchanges of which are controlled by conductivity, radiation, and convection to the outside, which thus avoids overheating the monolith of the catalyzer.

Moreover, trials have demonstrated that the temperature rise of the gases entering the catalyzer, with exhaust piping equipped with the composite tube of the invention, was five times more rapid than with conventional exhaust piping.

Figure 4:
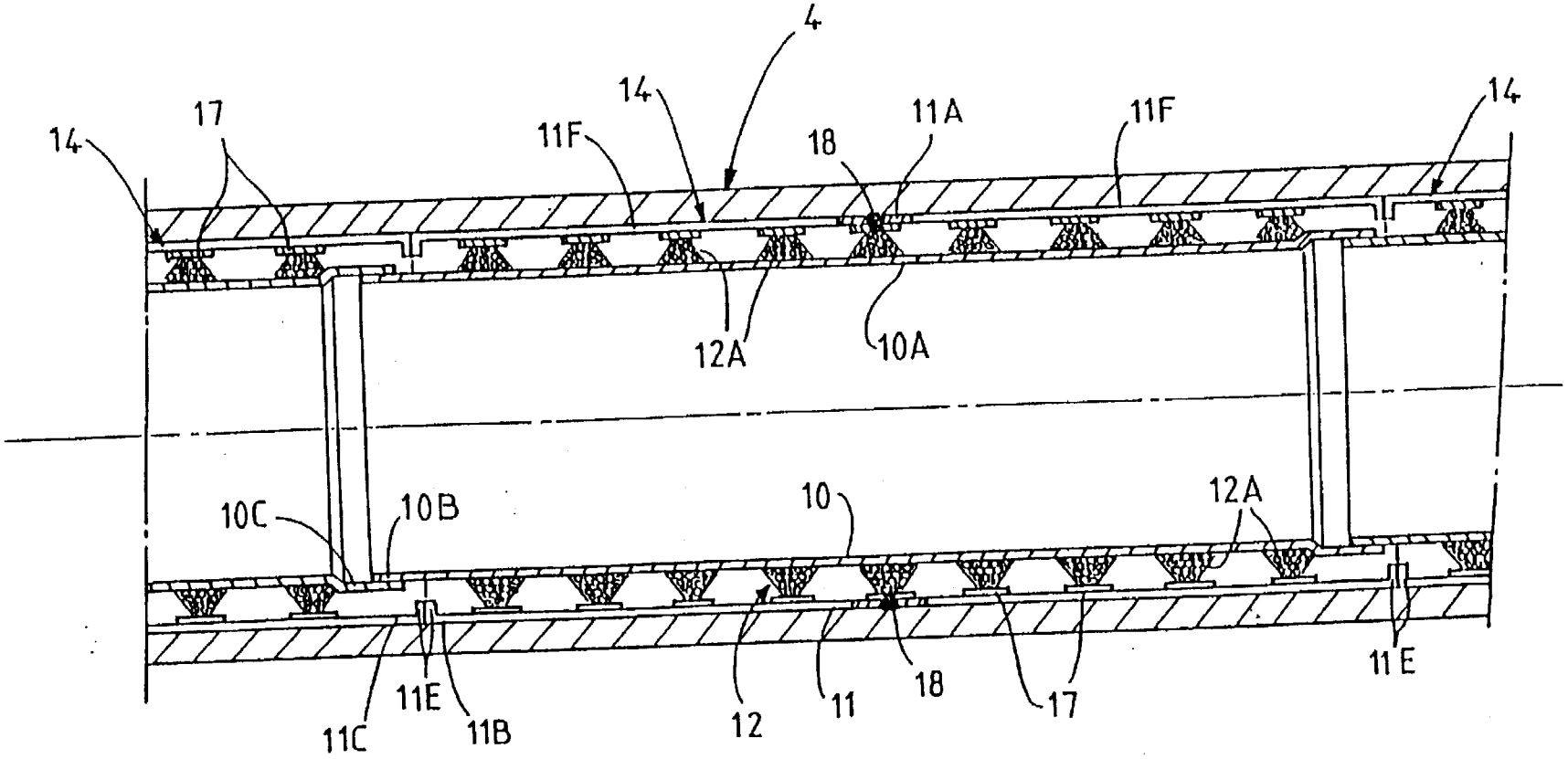
FIG. 4 represents another embodiment of individual elements of said tube, fitted in said exhaust piping.

According to the embodiment of the element 14 shown in FIG. 4, the substance 12 is of the fibrous type. In this case, the annular space 9 contains windings in the form of bands 12A of long fibers (continuous rovings) thus affording acceptable radial rigidity to prevent deformation of the internal tube 10. In particular, these bands of fibers 12A are uniformly spaced apart along the outside wall 10A of the internal tube 10, leaving identical spaces between them. Moreover, they exhibit a substantially trapezoidal cross section so that the long base of each of them is correctly fixed to the wall 10A of the internal tube by means of an adhesive, such as a high temperature ceramic glue. On the short bases of said bands, corresponding to the winding of the last row of turns of said fibers, there are attached rings 17 which are preferably split to facilitate their fitting, said split rings 17 then again being fixed to the corresponding small bases of said bands by a high temperature glue.

Once the "internal tube 10/bands 12A/rings 17" assembly has been achieved, the whole thus assembled is inserted into the external tube 11 which, unlike the one illustrated in FIGS. 2 and 3, has semi-emerging lateral slits 11F at its ends 11B, 11C, making fitting easier.

When the aforementioned whole is suitably installed relative to the external tube 11, the central band 12A and its attached ring 17 is substantially in the mid-plane of the external tube, from which, on either side, the semi-emerging slits 11F originate. Spots of welding 18 then immobilize the external tube 11 of the whole in order to constitute the individual element 14 of the composite tube 8. Of course this embodiment does not require recourse to be had to rings 15 and 16 and to radial projections 10D and 11D for holding the substance 12. In contrast, the ends of the external tube 11 may both be bent inward to form turned-in parts 11E which come substantially against corresponding turned-in parts when the elements 14 are fitted one inside the other.

During operation, the differential extensions of the tubes 10 and 11 along the longitudinal axis are allowed by slippage of the rings 17, driven along by the bands 12A along the external tube 11. These differential extensions are moreover distributed respectively on either side of the mid-plane of the external tube, owing to the rigid fixing of the central ring 17 thereto, which is mechanically more satisfactory. As far as the radial extensions, which are smaller, are concerned, these are absorbed by the bands of fibers which are not attached to one another.

The advantages afforded by this variant embodiment of the composite tube, illustrated in FIG. 4, are similar to those given by the previous embodiment illustrated in FIGS. 2 and 3. However, this variant makes it possible easily to optimize the composite tube mechanically and thermally by altering especially the shape (cross section) of the fibrous bands, their number, or in other words their spacing, the arrangement of the rovings (tangential or crossed) and the nature of the fibers.

We claim:

1. Exhaust piping for a catalytic gas exhaust system including a gas manifold (2) and a catalyzer (5), said piping (4) being situated between said manifold and said catalyzer and provided with a composite tube (8) which comprises an internal tube and of an external tube defining between them a substantially annular space, characterized in that said composite tube (8) is housed inside said exhaust piping (4), the external tube coming substantially into contact with said piping, and in that said internal tube (10) and external tube (11) exhibit thin walls (10A, 11A), the thickness of which is less than 0.3 millimeter.

2. Composite tube of the type including an internal tube and an external tube which define between them a substantially annular space, and which is intended to be associated with a catalytic gas exhaust system having exhaust piping, which exhaust piping is situated between a manifold for said gases and a catalyzer of the system, characterized in that the thickness of the walls (10A, 11A) of said internal tube (10) and external tube (11) is less than 0.3 millimeter and in that the outside diameter of said external tube (11) is at most equal to the inside diameter of said piping.

3. Composite tube according to claim 2, characterized in that the thickness of the walls of said internal tube (10) and external tube (11) is of the order of 0.15 to 0.20 millimeter.

4. Composite tube according to claim 2, characterized in that said internal tube (10) and external tube (11) are made of stainless steel.

5. Composite tube according to claim 2, characterized in that, in said annular space (9) delimited by said external tube (11) and internal tube (10), there is arranged a substance (12) with low heat capacity and low density, in the form of particles or fibers.

6. Composite tube according to claim 5, characterized in that the heat capacity of said substance is of the order of 0.25 kcal/kg and its density is at most equal to 0.3.

7. Composite tube according to claim 5, characterized in that rings (15, 16) are provided at the ends of said internal tube (10) and external tube (11), closing off said annular space (9) in order to contain said substance (12).

8. Composite tube according to claim 7, characterized in that, in each end of said tubes (10, 11) there are housed a flexible insulating ring (15), which is housed in said space and comes into contact with said substance (12) of low heat capacity and low density, and a rigid, thermally resistant ring (16) which is mounted in said space and comes into contact with said flexible insulating ring (15).

9. Composite tube according to claim 5, characterized in that fibrous windings of substance (12) are fixed to the outside of said internal tube (10), and spaced apart by empty spaces, said external tube coming substantially into contact with said fibrous windings of substance.

10. Composite tube according to claim 9, characterized in that said windings are defined by a plurality of fibrous bands (12A) surrounding said internal tube fixedly and at regular spacings, and exhibiting a trapezoidal or similar cross section, rings (17) being attached around said fibrous bands in order to fit inside the external tube (11) and be fixed, by at least one of these, to said external tube.

11. Tube according to claim 1, characterized in that it consists of a plurality of individual elements (14) which can be joined together.

12. Tube according to claim 11, characterized in that each individual element (14) comprises an external tube (11) and an internal tube (10), both with thin walls, and a substance (12) with low heat capacity and low density arranged between said tubes.

13. Tube according to claim 12, characterized in that, when two individual elements are joined together, the corresponding ends (10B, 10C) of the internal tubes fit one inside the other, whereas the corresponding ends (11B, 11C) of the external tubes butt up against each other.

* * * * *